US006471053B1

(12) United States Patent
Feibelman

(10) Patent No.: US 6,471,053 B1
(45) Date of Patent: Oct. 29, 2002

(54) DISPLAY AND STORAGE DEVICE

(75) Inventor: Jeffrey A. Feibelman, Providence, RI (US)

(73) Assignee: Display Technologies, Inc., Johnston, RI (US)

( * ) Notice: Subject to any disclaimer, the term of this patent is extended or adjusted under 35 U.S.C. 154(b) by 23 days.

(21) Appl. No.: 09/735,955

(22) Filed: Dec. 13, 2000

(51) Int. Cl.[7] ..... A45C 11/04
(52) U.S. Cl. ..... 206/6.1; 206/495
(58) Field of Search ..... 206/6.1, 486, 737, 206/495, 756, 757; 211/85.2

(56) References Cited

U.S. PATENT DOCUMENTS

| | | | | |
|---|---|---|---|---|
| 1,653,246 | A | * 12/1927 | Zichy | 190/10 |
| 2,346,564 | A | 4/1944 | Drullard | |
| 2,841,282 | A | 7/1958 | Fuente | |
| 2,850,160 | A | 9/1958 | Siebel et al. | |
| 3,223,233 | A | 12/1965 | Becker et al. | |
| 4,175,660 | A | 11/1979 | Feibelman | |
| D261,729 | S | 11/1981 | Feibelman | |
| 4,312,449 | A | 1/1982 | Kinderman | |
| 4,332,320 | A | 6/1982 | Feibelman | |
| 4,422,552 | A | 12/1983 | Palmer et al. | |
| 4,496,354 | A | 1/1985 | Steer et al. | |
| 5,184,724 | A | 2/1993 | Mayled | |
| 5,593,025 | A | 1/1997 | Feibelman | |
| 5,697,502 | A | 12/1997 | Linz | |
| 5,779,033 | A | 7/1998 | Roegner | |
| 6,244,431 | B1 * | 6/2001 | VanFleet | 206/459.5 |

FOREIGN PATENT DOCUMENTS

| | | |
|---|---|---|
| GB | 1589963 | 5/1981 |

* cited by examiner

*Primary Examiner*—David T. Fidei
(74) *Attorney, Agent, or Firm*—Salter & Michaelson

(57) ABSTRACT

A combination display and storage device including a foldable display card having an outer surface and an inner surface, a removable support member constructed and arranged to display an item on the outer surface of the card, and a storage member supported within an interior section of the card member is disclosed. In an assembled position, the card is foldable about a median area, and the tail end is engaged with the upper end in order to form an interior section for receiving the removable storage member, such as a pouch. The display and storage device can be utilized to both display a product, such as an article of jewelry, on the outer surface to a consumer and can also thereafter be used to store the product in a convenient manner.

23 Claims, 9 Drawing Sheets

DISPLAY AND STORAGE DEVICE

DESCRIPTION

1. Technical Field

The invention relates generally to a display device and, more specifically to an improved display device for displaying a product to a consumer and a storage member for storing the product therein.

2. Background of Related Art

Various devices have been utilized over the years in order to hold and display numerous products to consumers. For example, display cards have been utilized to display a variety of products to consumers such as jewelry, buttons, hair accessories, and other smaller size products. Regardless of the type of product displayed, ideally the display card and product should be relatively easy to assemble, and the card should display the item in an aesthetically appealing manner. A variety of different style display cards for displaying items, such as articles of jewelry, are known in the art. Jewelry display cards may include a generally planar outer surface having a member to secure the article of jewelry thereto, and a hook or aperture for engaging a support member such as a display rack or rod. The securing member may take a variety of forms, depending upon the type of jewelry supported on the display card. Conventional jewelry display cards may include apertures for receiving earrings, pins, etc. and may also include one or more slots for receiving a necklace, bracelet or other items. When a consumer purchases jewelry supported on a display card, the display card is usually given to the consumer with the article of jewelry supported thereon. Generally, the jewelry is not provided to the consumer in a box or other packaging, and the display card is discarded by the consumer after removing the jewelry from the card. The consumer is thereafter left to store the article of jewelry in a jewelry box or other such device.

In addition to display cards, bags or pouches have also been utilized to hold and display products to consumers. In some cases the bags or pouches are part of a package which is displayed on a support member. For example, U.S. Pat. No. 2,850,160 to Siebel et al. discloses a package (10) including an inner, transparent container or envelope (11) for holding a product, and a window (17) which permits direct viewing through the package of the packaged product. An aperture (22) may be provided in the tongue (19) for mounting or displaying the package from a rod, or the like. U.S. Pat. No. 5,184,724 to Mayled likewise discloses a package (34) for supporting a flexible, transparent pouch (10) which holds small items therein. The package includes an opening (40) through which a portion of the pouch is visible so that consumers can see items (44) which are in the pouch. In addition, U.S. Pat. No. 4,332,320 to Feibelman discloses a pendant display card including a card (12) having a hanger member (13) for suspending the card from a support. In one embodiment, a foam sheet is bonded to the display card on three edges of its perimeter to form a pouch or envelope (42) suitable for receiving a portion of article of jewelry, such as a chain, therein. With each of the above display pouches, the pouch or envelope is bonded or otherwise formed as part of the display card, therefore, it is not intended to be utilized separately from the display card itself.

While generally effective for displaying a variety of products, there currently does not exist a display card which can be utilized to display a product, such as an article of jewelry, to a consumer and which includes a removable and reusable device for storing the item after purchase by the consumer.

SUMMARY

An object of the present invention is to provide a display device which can be utilized to display a product, such as an article of jewelry, to a consumer and which includes a removable and reusable storage member for storing the product therein after purchase.

In accordance with one aspect, there is provided a combination display and storage device including a foldable card member having an outer surface and an inner surface, a support member constructed and arranged to display an item on the outer surface of the card member, and a removable storage member supported within the card member. In an assembled position, the card is foldable about a median area, and the tail end is engaged with the upper end in order to form an interior section for receiving the storage member, such as a pouch. The pouch is removably secured to the card within the interior section, is reusable after removal, and is dimensioned to receive the item supported on the outer surface such that a consumer can utilize the pouch to store the item.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENTS

A display and storage device 10 for displaying and storing an item, such as an article of jewelry, is illustrated in FIGS. 1–10. As used herein, the term "item" refers to any article or product sold to a consumer. Also as used herein, the term "pouch" refers to any bag, sack, packet, envelope or the like where an item can be repeatedly stored and removed.

Figure 1:
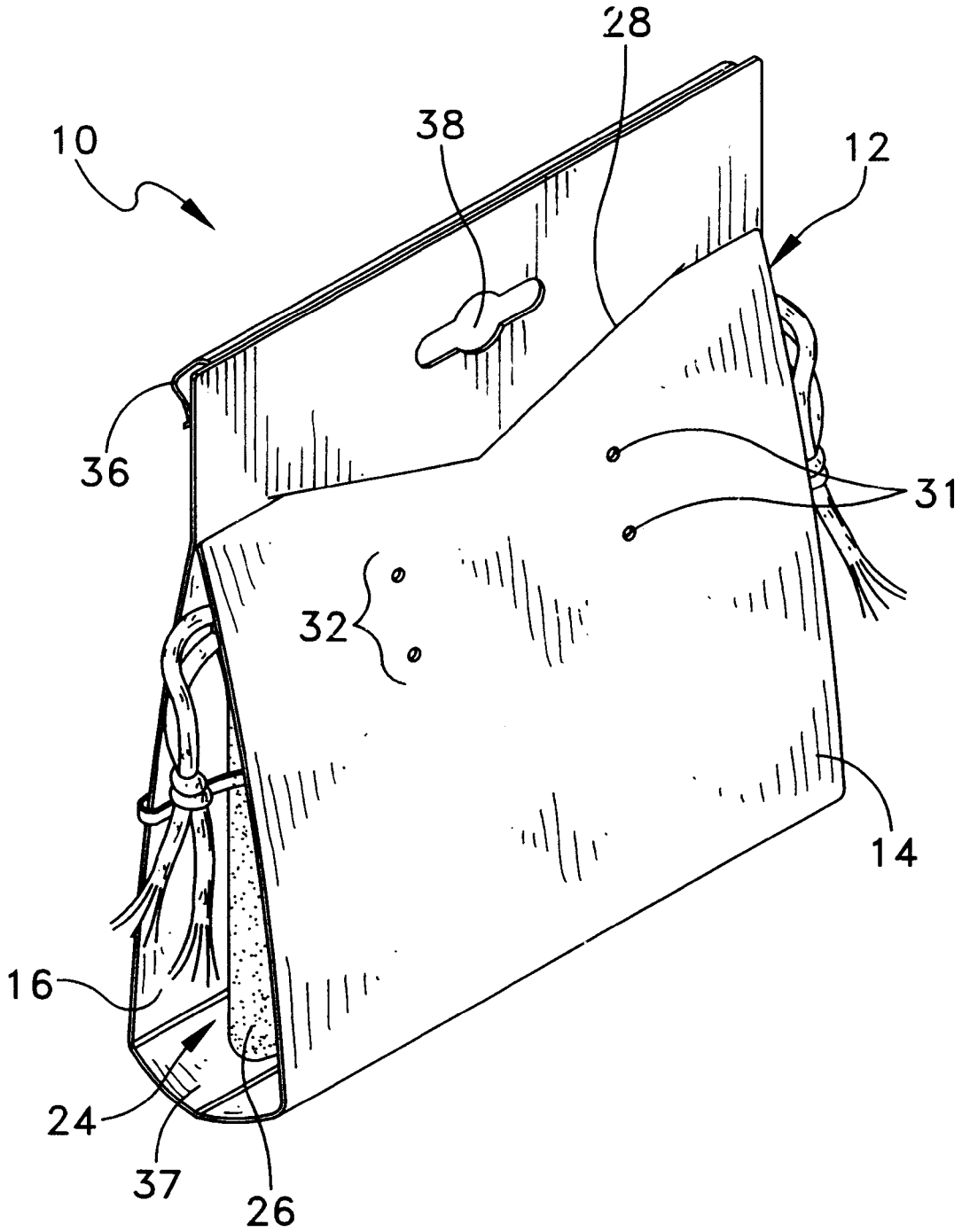
FIG. 1 is a perspective view of a display and storage device for displaying an article of jewelry, in an assembled or closed position, including a display card and pouch according to a first embodiment of the present invention.
Figure 2:
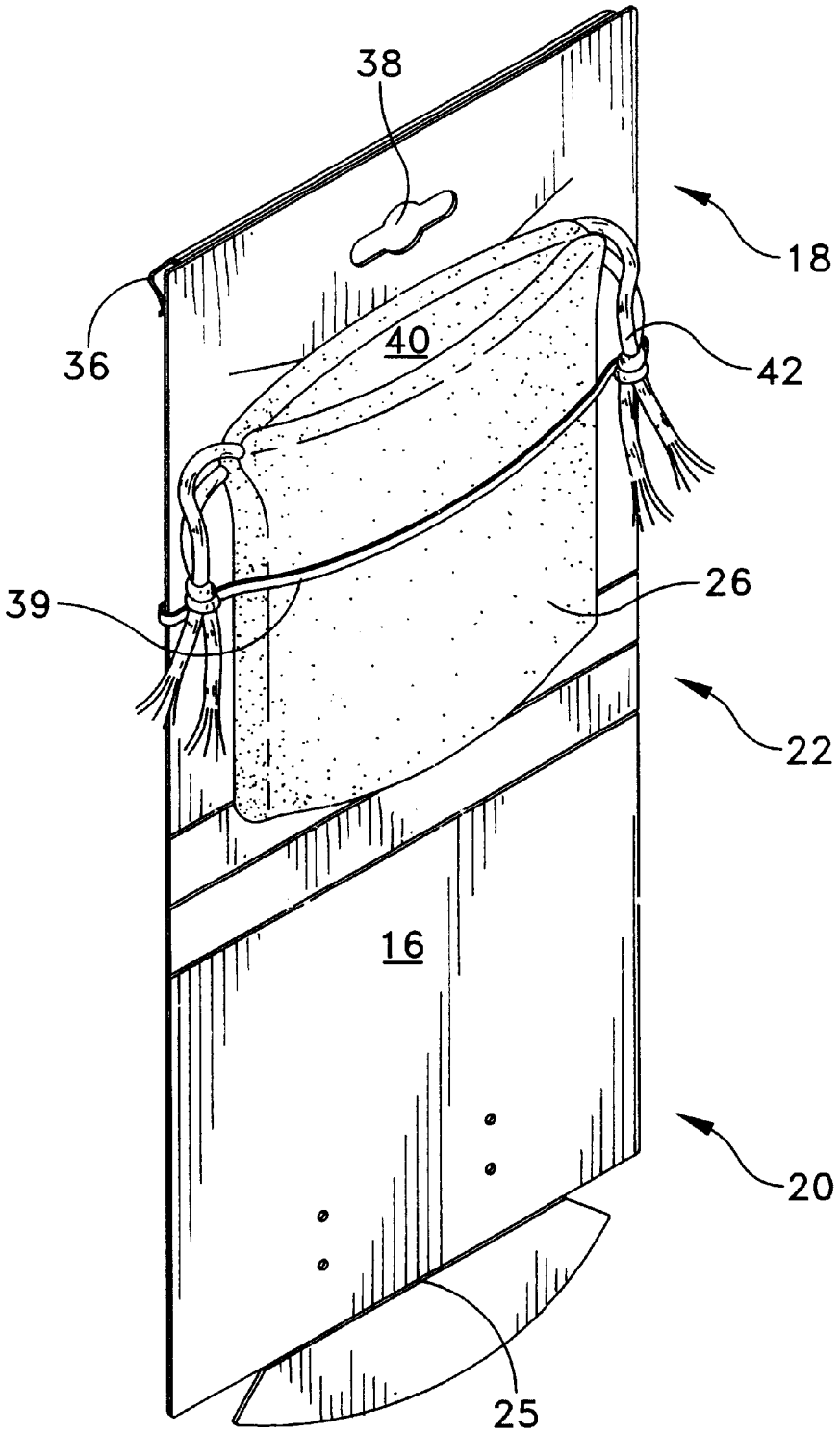
FIG. 2 is a perspective view of the display and storage device of FIG. 1 in an open position.
Figure 3:
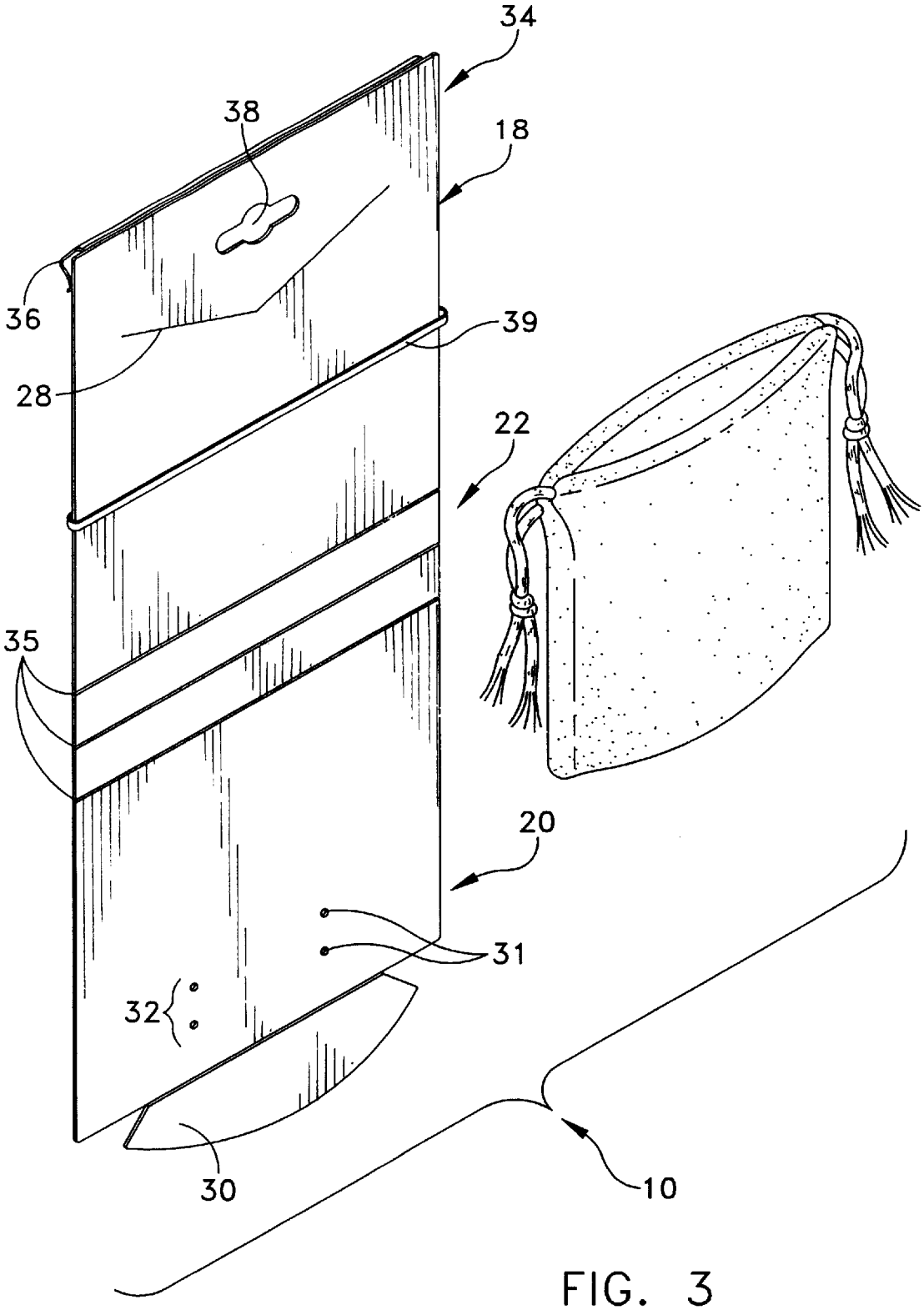
FIG. 3 is a perspective view of the display and storage device of FIG. 2, with the storage pouch removed.
Figure 4:
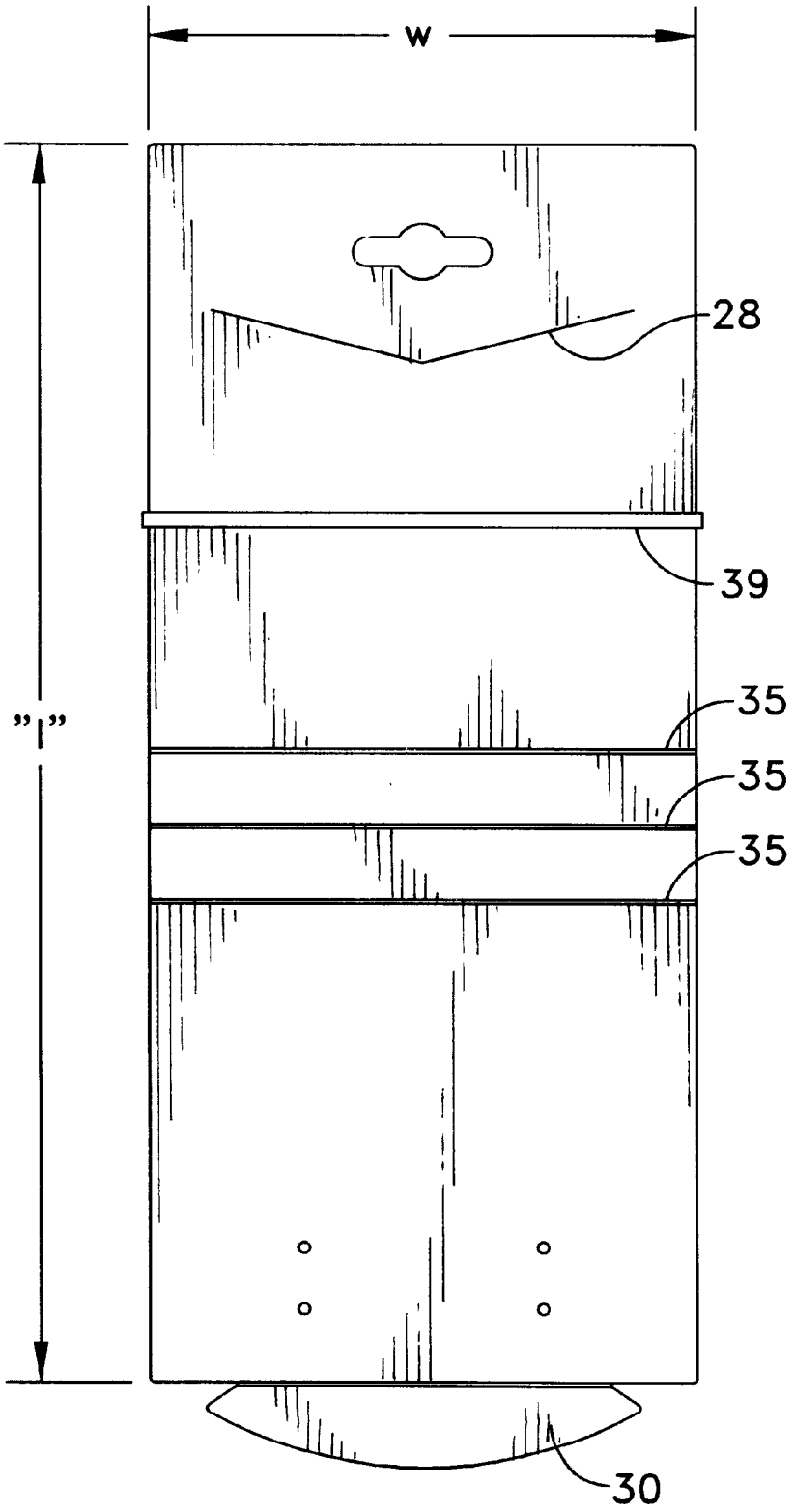
FIG. 4 is a front view showing the interior of the display card of FIG. 1.
Figure 5:
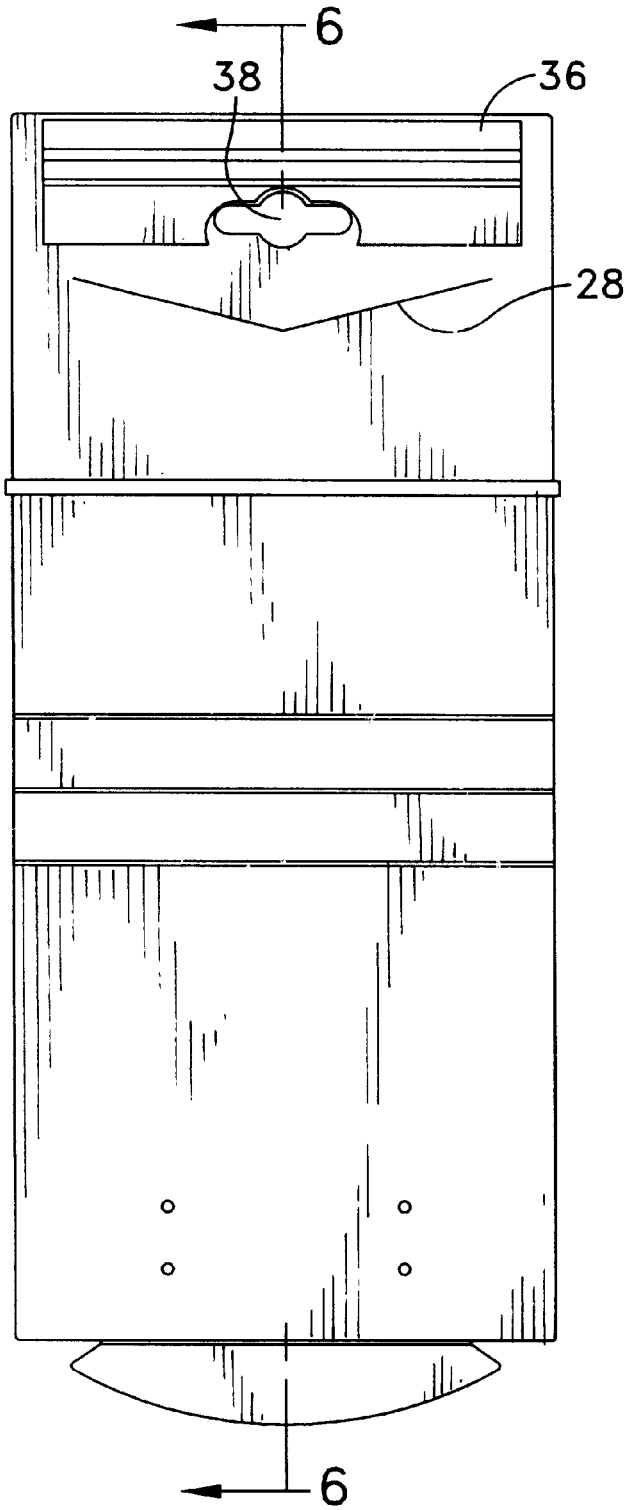
FIG. 5 is a rear view showing the exterior of the display card of FIG. 4.
Figure 6:
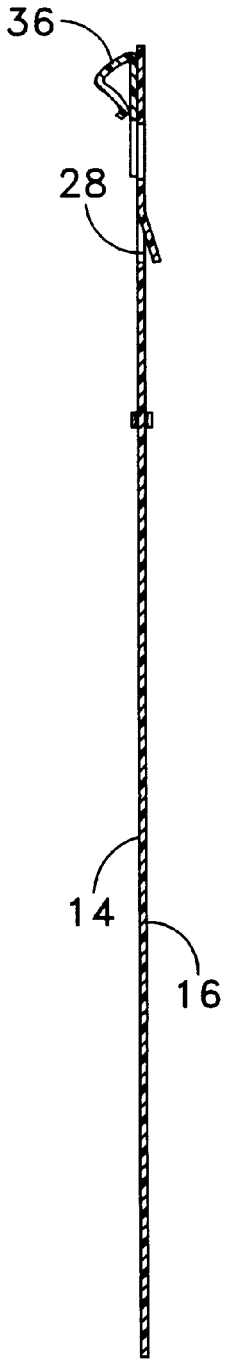
FIG. 6 is a side, cross-sectional view taken along lines 6—6 of FIG. 5.
Figure 7:
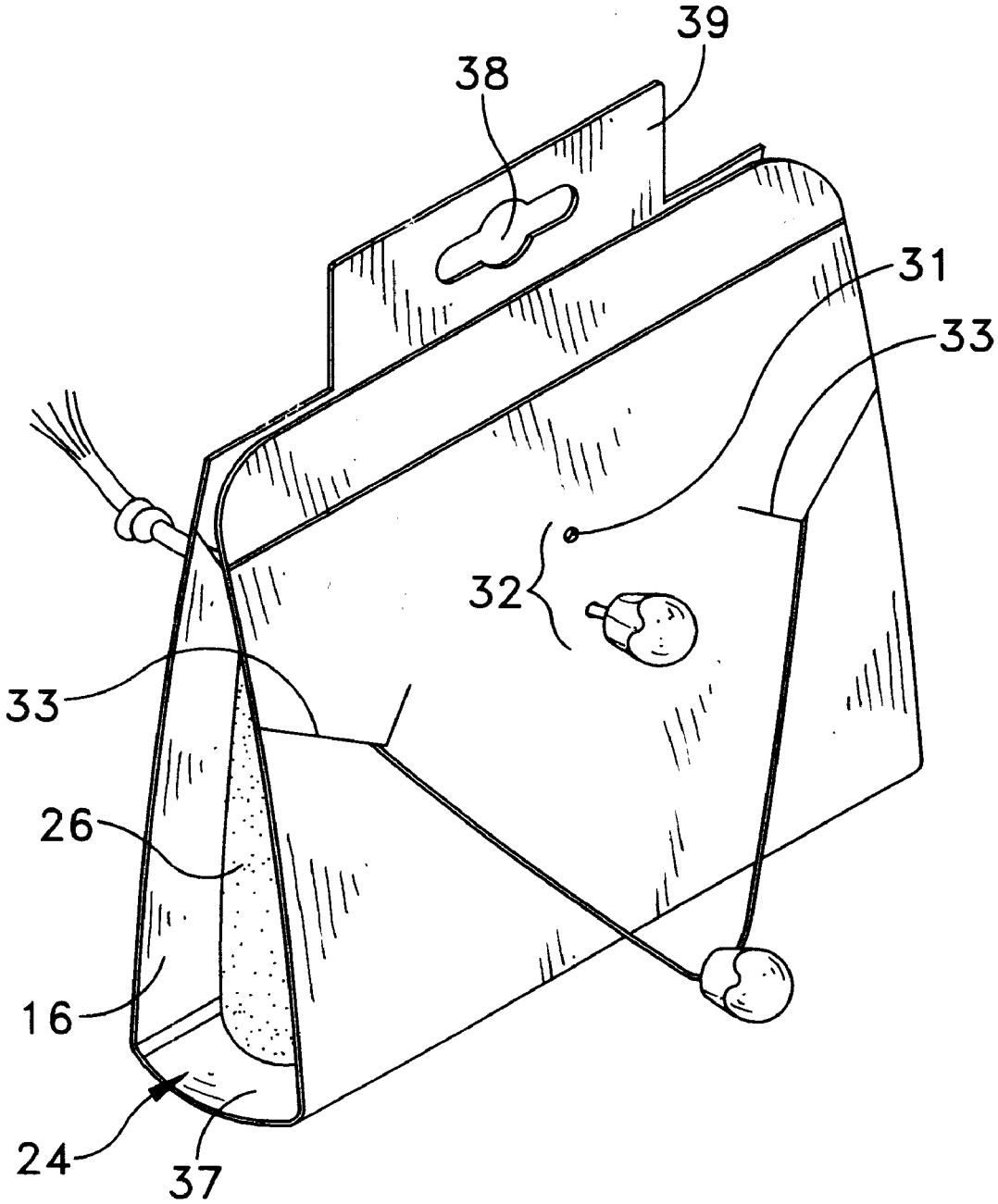
FIG. 7 is a perspective view of a display and storage device for displaying an article of jewelry, in an assembled or closed position, including a display card and pouch according to a second embodiment of the present invention.
Figure 8:
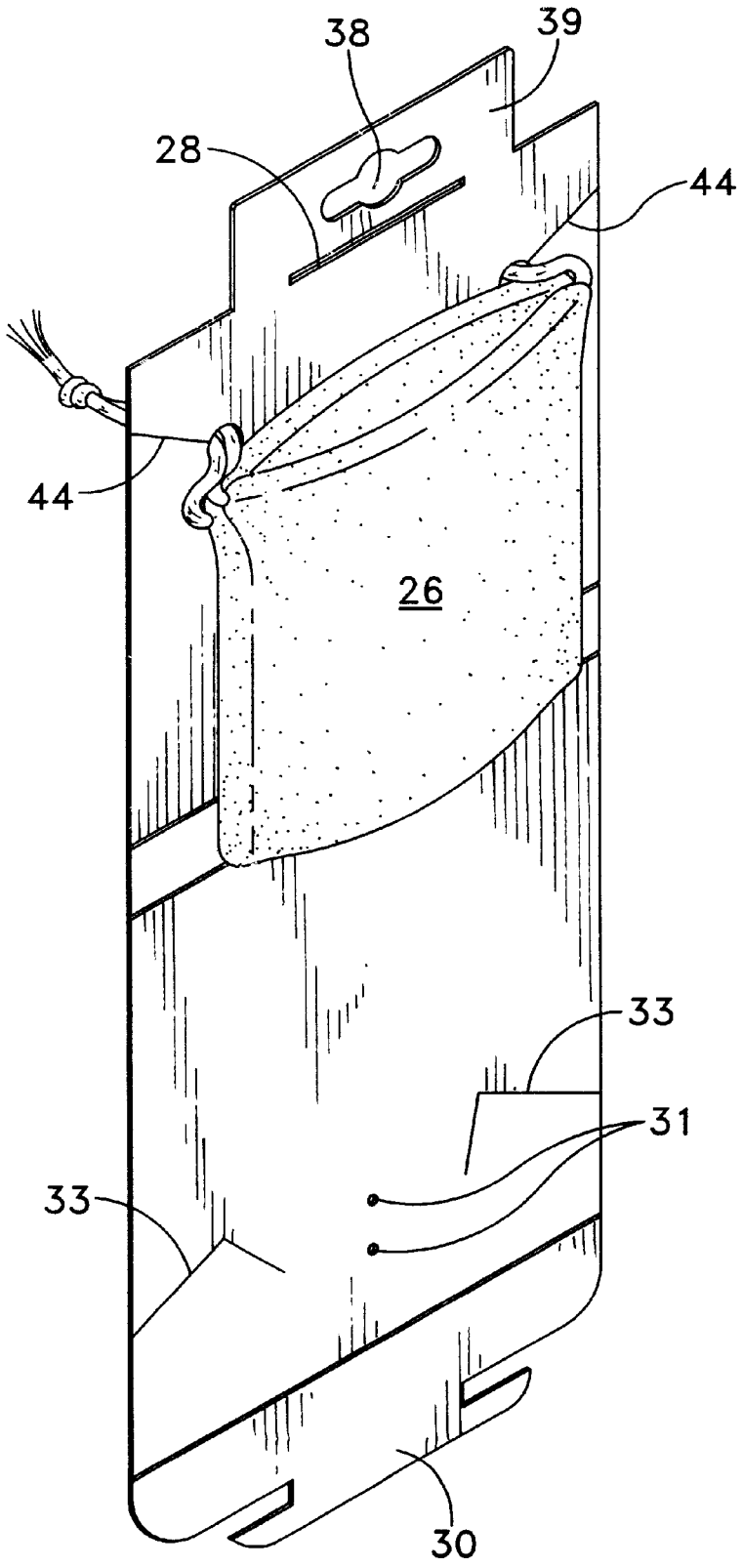
FIG. 8 is a perspective view of the display and storage device of FIG. 7 in an open position.
Figure 9:
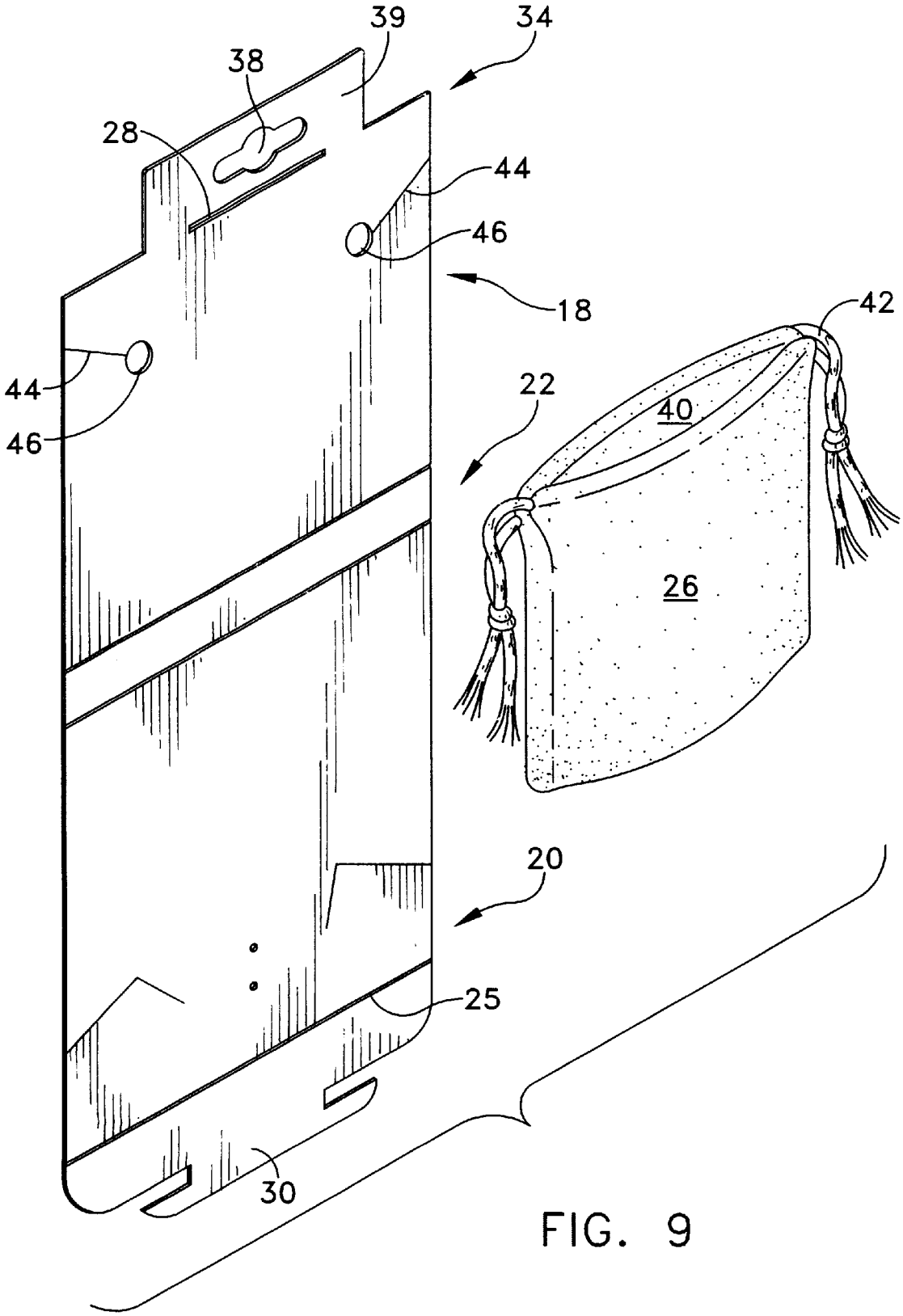
FIG. 9 is a perspective view of the display and storage device of FIG. 8, with the storage pouch removed.
Figure 10:
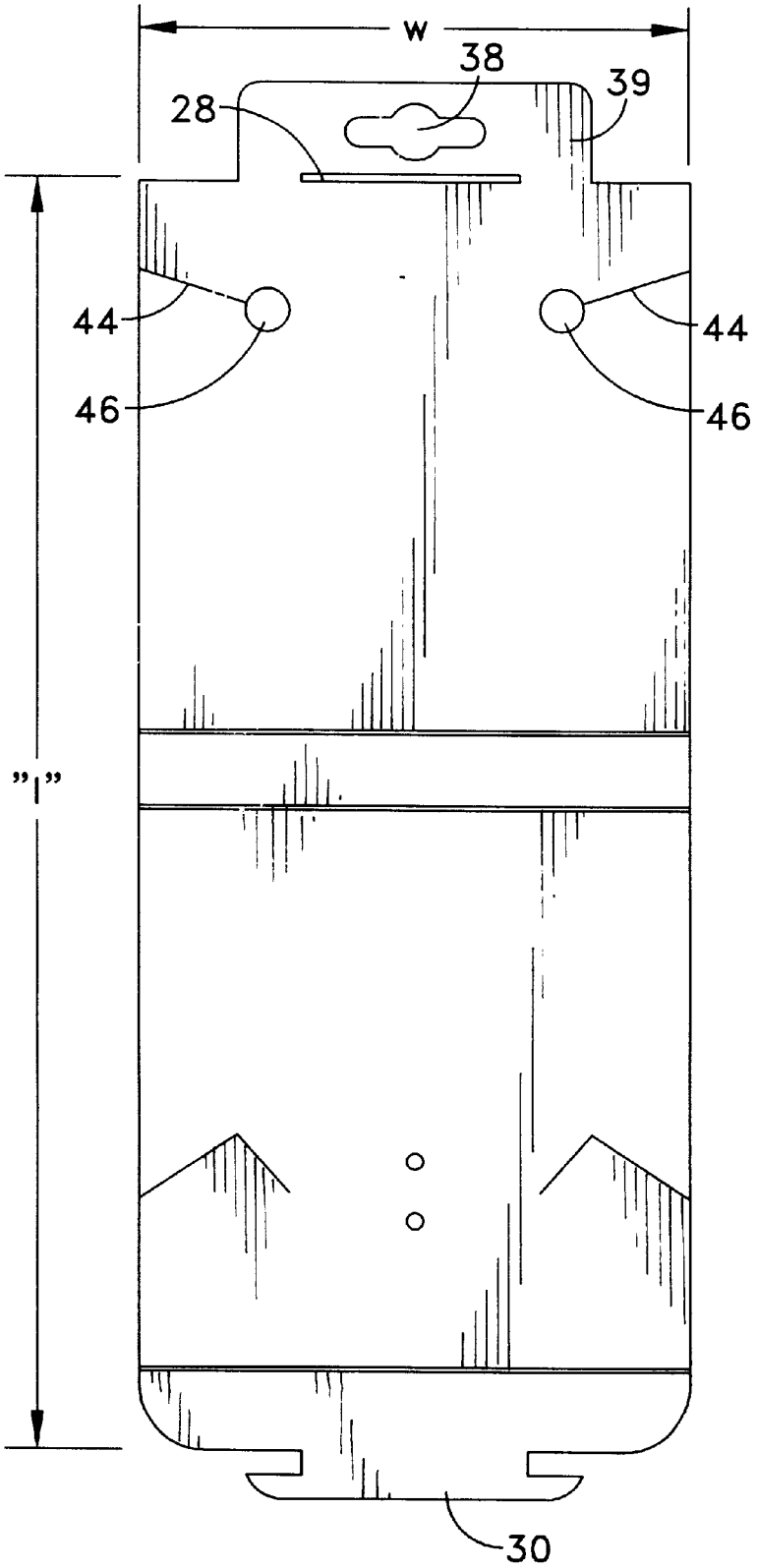
FIG. 10 is a front view showing the interior of the display card of FIG. 7.

Referring to the figures, the device 10 includes a foldable card 12 including an outer surface 14 and an inner surface 16, both of which may be substantially planar. The card member further includes an upper end 18, a tail end 20 opposite the upper end, and a median or fold area 22 disposed between the upper end and the tail end (FIGS. 3 and 9). In an assembled position, card 12 is foldable about the median area 22, and the tail end 20 is engaged with the upper end 18 in order to form an interior cavity or section 24 for receiving a storage member 26 therein. In the present embodiments, an opening or slit 28 is formed in the upper end which receives a tab 30 supported on the tail end in order to releasably secure the tail end with the upper end. As shown in FIGS. 3 and 8, the opening and tab may have a variety of shapes and/or sizes, provided that the tab matingly engages and is held within the opening in the assembled position. In order to facilitate insertion of the tab within the opening, the opening of FIG. 3 preferably includes a widened "V" shape. To prevent the tab from inadvertently becoming disengaged, the tab may be wider at its distal end as also shown in FIG. 3. A score line 25 may be formed adjacent the tab to facilitate insertion of the tab within the opening. Alternate methods of securing the tail end to the upper end may also be utilized as would be known to those of skill in the art.

Located on the tail end 20 of the card 12 is a support member 32 designed to hold and display an item on the outer surface 14 thereof. The support member may be any of a number of conventional support members known in the art, including but not limited to one or more apertures 31 for receiving earrings, pins, etc., one or more slots 33 for receiving a necklace, bracelet or other items (FIG. 7), and the like.

In the present embodiments, the card may preferably be formed as a unitary, molded semi-flexible plastic member which can be folded without breaking. In order to facilitate folding of the card, one or more pre-formed fold or score lines 35 may be provided in the median area 22. The score lines 35 may be formed in any suitable manner, as would be known to those of skill in the art. The score lines enable the card member to be readily folded without breaking, and may define the edges of a base 37 of the assembled card member. The card member may be any suitable size, depending upon the items to be displayed and the particular display component. For example, in the embodiment of FIGS. 1–6, the overall length, "l" of the card is between about 5½ inches to about 6 inches, and is most preferably about 5⅝ inches, while the width, "w" is between about 2 inches to about 3 inches, and is most preferably about 2½ inches.

The display device also preferably includes an engagement member 34 constructed and arranged to engage a display component. The engagement member 34 may take any of a variety of forms, suitable for engagement with a display component. Since the majority of display components are rods or display racks, the engagement member of FIGS. 1–6 includes both a hook 36 for attachment to a display rack, and an aperture 38 for engaging a display rod, while the engagement member of FIGS. 7–10 is illustrated as an aperture 38 disposed in a hanging tab 39 supported on the upper end of the card. Other types of engagement members may be utilized depending upon the display component, as would be known to those of skill in the art. In the present embodiment, the card and engagement member are formed as a unitary piece. Alternatively, the engagement member may be formed separately and may be secured to the card as would be known to those of skill in the art.

Supported within the interior section 24 of the assembled display card is storage member 26. In the present embodiments, the storage member is a pouch including an opening or mouth 40 for inserting and removing an item therein. The pouch is preferably sized to fit substantially within the interior section 24 and to hold the item displayed on the outer surface. The pouch may include a closure device 42 for closing the mouth of the pouch so that the item held therein will remain within the pouch until removed by the consumer. As shown in the figures, the closure device may be a drawstring which, when pulled, closes the mouth of the pouch. The closure device may take other forms, as would be known to those of skill in the art, for example, a flap which can be secured over the mouth of the pouch. The storage member 26 may preferably be removably secured within the interior section 24 of the display card so that the user can remove and use the storage member after purchase without damaging the storage member. In the embodiment of FIGS. 1–6, the storage member is removably secured to the inner surface 16 of the card by a band of material 39, for example an elastic band. In the embodiment of FIGS. 7–10, the storage member is removably secured to the inner surface 16 of the card by inserting the drawstring 42 through slots 44 and into opening 46 in the upper end 18. The storage member is preferably removably secured to the upper end of the display card so as to not interfere with the one or more support members 32 which are disposed on the tail end 20 and which are utilized to support the item. The storage member is reusable and may be made of any suitable material.

Use of the display and storage device 10 will now be described with reference to the drawings.

In use, the display and storage device 10 is initially in a non-secured position where the card member is fully extended (FIGS. 2–6 and 8–10). The storage member is then removably secured to the card on the inner surface 16, adjacent the upper end 18. For example, the storage member may be secured by a band which extends around both the storage member and the upper end of the card or by a portion of the storage member, such as the drawstring, being disposed within openings in the upper end. The item, such as an article of jewelry, is then secured to the support member and the tail end 20 is engaged with the upper end 18 in order to form an interior section 24 for receiving the storage member 26. The support member is preferably disposed at the tail end of the card member such that the support member is adjacent the top end in the assembled position, and the item is supported on the outer surface 14. In the present embodiments, the card is folded about the score lines 32 and the tab 30 is inserted within slit 28 so as to releasably secure the tail end to the upper end. Once assembled, the device may be supported on a display component, such as a rod or rack, by the engagement member 34. The article of jewelry (or other item) can thereafter be removed from the card, and the card may be opened to reveal the pouch, such as by removing the tab from within the slot, or by otherwise opening the card. Once in the opened position, the pouch may be removed from engagement with the card without damaging the pouch. The article of jewelry may then be placed within the pouch for storage and/or transportation, as desired. It will be appreciated that the display and storage device as described can be utilized to both display a product, such as an article of jewelry, to a consumer and can also thereafter be used to store the product therein in a convenient manner.

It will be understood that various modifications may be made to the embodiments disclosed herein. For example, it should be understood that the card member need not be unitary in construction, that the dimensions may vary and fall within a range, that the stated dimensions are an illustrative embodiment, and that any suitable material may be utilized for the card and pouch, provided that the card is foldable and can support the item thereon. Therefore, the above description should not be construed as limiting, but merely as exemplifications of preferred embodiments. Those skilled in the art will envision other modifications within the scope, spirit and intent of the invention.

What is claimed is:

1. A combination display and storage device for displaying and storing an ornamental item, the device comprising:

an engagement member constructed and arranged to engage a display component;

a card member including an outer surface, an inner surface, an upper end adjacent the engagement member, a tail end opposite the upper end, and a median fold area disposed between the upper end and the tail end;

a support member constructed and arranged to display an ornamental item on the outer surface of the card member;

a storage member removably secured to the card member and configured and arranged to receive the item therein; and wherein in an assembled position the card member is folded about the median fold area and a portion of the tail end is engaged with the upper end, the storage member being removably supported within an interior section of the assembled card member.

2. The display and storage device of claim 1, wherein the support member is disposed at the tail end of the card member such that the support member is adjacent the top end in the assembled position.

3. The display card and storage device of claim 1, wherein the ornamental item is an article of jewelry.

4. The display and storage device of claim 1, in combination with an article of jewelry supported on the outer surface of the tail end of the card member in the assembled position.

5. The display and storage device of claim 2, wherein the support member includes one or more apertures disposed through the card member.

6. The display and storage device of claim 2, wherein the support member includes one or more slots constructed and dimensioned to receive a portion of an article of jewelry therethrough.

7. The display and storage device of claim 1, further comprising or more pre-formed fold lines disposed in the median area and constructed and arranged to facilitate folding of the card member.

8. The display and storage device of claim 1, further comprising an opening disposed through the card member adjacent the upper end, and a tab supported on the tail end which is constructed and arranged fit within the opening, wherein in the assembled position the tab is inserted within the opening in order to releasably secure the tail end to the upper end of the card member.

9. The display and storage device of claim 1, wherein the storage member is releasably secured within the interior section by a band.

10. The display and storage device of claim 1, wherein the storage member is releasably secured within the interior section through one or more openings disposed in the upper end.

11. The display and storage device of claim 1, wherein the engagement member comprises an aperture constructed and dimensioned to engage a display rod.

12. The display and storage device of claim 1, wherein the engagement member comprises a hook, the hook being constructed and arranged to engage a display component.

13. The display and storage device of claim 1, wherein the engagement member and card member are formed as a unitary structure.

14. A combination display and storage device for displaying and storing an article of jewelry, the device comprising:

an engagement member constructed and arranged to engage a display component;

a card member including an outer surface, an inner surface, an upper end adjacent the engagement member, a tail end opposite the upper end, and a median fold area disposed between the upper end and the tail end;

a support member constructed and arranged to display the article of jewelry on the outer surface of the card member;

a pouch removably secured to the inner surface of the card member and constructed and dimensioned to receive the article of jewelry therein; and wherein in an assembled position the card member is folded about the median fold area and a portion of the tail end is engaged with the upper end, the pouch being supported within an interior section of the assembled card member and the article of jewelry being supported on the outer surface of the support member.

15. The display and storage device of claim 14, wherein the support member is disposed at the tail end of the card member such that the support member is adjacent the top end in the assembled position.

16. The display and storage device of claim 14, wherein the support member is selected from the group consisting of one or more apertures and one or more slots.

17. The display and storage device of claim 14, further comprising an opening disposed through the card member adjacent the upper end, and a tab supported on the tail end which is constructed and arranged fit within the opening, wherein in the assembled position the tab is inserted within the opening in order to releasably secure the tail end to the upper end of the card member.

18. The display and storage device of claim 14, wherein the pouch is secured within the interior section by a band.

19. The display and storage device of claim 14, wherein the pouch includes a drawstring and is secured within the interior section by the drawstring engaging one or more openings in the card member.

20. The display and storage device of claim 14, wherein the engagement member comprises an aperture in the card member, the aperture being constructed and dimensioned to engage a display rod.

21. The display and storage device of claim 14, wherein the engagement member comprises a hook, the hook being constructed and arranged to engage a display component.

22. The display and storage device of claim 14, wherein the engagement member and card member are formed as a unitary structure.

23. The display and storage device of claim 14, further comprising or more pre-formed fold lines disposed in the median area and constructed and arranged to facilitate folding of the card member.

* * * * *